US005873138A

United States Patent [19]

Geyer et al.

[11] Patent Number: 5,873,138

[45] Date of Patent: Feb. 23, 1999

[54] LOST MOTION FOOT PEDAL LINKAGE

[75] Inventors: Robert A. Geyer, Champlin; Karl R. Hansen, Cottage Grove, both of Minn.

[73] Assignee: Tennant Company, Minneapolis, Minn.

[21] Appl. No.: 980,786

[22] Filed: Dec. 1, 1997

[51] Int. Cl.[6] ..... A47L 11/30

[52] U.S. Cl. ..... 15/50.1; 15/320; 15/340.1; 15/340.3

[58] Field of Search ..... 15/50.1, 98, 320, 15/340.1, 340.3, 340.4

[56] References Cited

U.S. PATENT DOCUMENTS

| | | | |
|---|---|---|---|
| 2,300,280 | 10/1942 | Teager | 15/340.3 X |
| 2,829,391 | 4/1958 | Swanson et al. | 15/340.3 X |
| 3,105,991 | 10/1963 | Oberg | 15/320 |
| 3,461,479 | 8/1969 | Tierney | 15/340.1 X |
| 4,194,263 | 3/1980 | Herpers et al. | 15/320 X |

*Primary Examiner*—Mark Spisich
*Attorney, Agent, or Firm*—Dorn, McEachran, Jambor & Keating

[57] ABSTRACT

An operator controlled scrubbing machine includes a body, wheels for supporting the body, a scrub brush on the body and a mechanism for raising and lowering the scrub brush. There is a squeegee on the body and a mechanism for raising and lowering the squeegee. The body includes a drive for moving the machine in forward and reverse directions and an operator controlled foot pedal for controlling the drive. There is a connection between the foot pedal and the drive providing for limited foot pedal movement prior to translating foot pedal movement into machine movement. There is a first sensor to sense machine forward movement of the foot pedal, which sensor is connected to the mechanism for raising and lowering the scrub brush. There is a second sensor to sense machine reverse movement, with the second sensor being connected to the mechanism for raising and lowering the squeegee. The first and second sensors are positioned to sense foot pedal machine forward and foot pedal machine reverse movements prior to such movements being translated into machine forward and machine reverse movements so that the scrub brush will be lowered prior to the machine moving forward and the squeegee will be raised prior to the machine moving in a reverse direction.

8 Claims, 2 Drawing Sheets

LOST MOTION FOOT PEDAL LINKAGE

THE FIELD OF THE INVENTION

The present invention relates to scrubbing machines and is also applicable to machines which combine both a scrubbing and a sweeping function. It is conventional in a scrubbing machine to use a foot pedal in which the operator pushes down with the toe of his foot to move the machine in a forward direction, and pushes down with his heel to move the machine in reverse. The harder the operator pushes, the faster will be the speed of the machine. When the operator relaxes his pressure on the foot pedal, it moves to neutral by means of a centering spring and is held in such a neutral position by a detent.

Scrubbers bear down quite heavily with their scrub brushes, and if they sit in one place for any time, they may mark the floor. Therefore, it is necessary that the brushes should be raised when the machine is in the neutral position. Also, scrubbers have trailing pickup squeegees that work fine in forward movement, but can be damaged if not raised off the floor when the machine moves in reverse. In the prior art manual controls available to the operator are used for raising and lowering the brushes and squeegees, but at times these controls are not used with consequent damage to the squeegee or damage to the floor.

In a machine using the present invention the operator has available an electronic logic control with two push buttons for placing the machine either in transport mode, in which both the brushes and the squeegee are raised, or scrub mode.

The present invention is concerned with the connection between the foot pedal and the machine drive, which in the scrub mode provides for automatic lowering of the brush just prior to the machine beginning its forward movement and raising of the squeegee just prior to the machine beginning a reverse direction movement. This connection between the foot pedal and the machine drive will also automatically raise the brushes just before the machine changes from forward motion to neutral, and automatically lower the squeegee just before the machine changes from reverse motion to neutral. The connection between the foot pedal and the machine drive has a certain degree of lost motion which insures that the scrub brush will move down or the squeegee will be raised just prior to the start of machine movement in the forward and reverse directions.

SUMMARY OF THE INVENTION

The present invention relates to scrubbing machines and in particular to the connection between an operator foot pedal and the drive mechanism for forward and reverse movement of the scrubbing machine.

A primary purpose of the invention is a foot pedal operated scrubbing machine in which there is a lost motion connection between foot pedal movement and machine movement, whereby the brushes and squeegees may be automatically lowered or raised, as required, just prior to machine forward or reverse movement.

Another purpose is to provide a simply constructed reliable lost motion connection between a scrubbing machine foot pedal and the scrubbing machine drive mechanism.

Another purpose of the invention is to provide a system of sensing machine movement, as determined by foot pedal operation, so as to automatically raise or lower the scrub brushes and squeegees, as the need requires, just prior to the start of machine forward or reverse movement.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
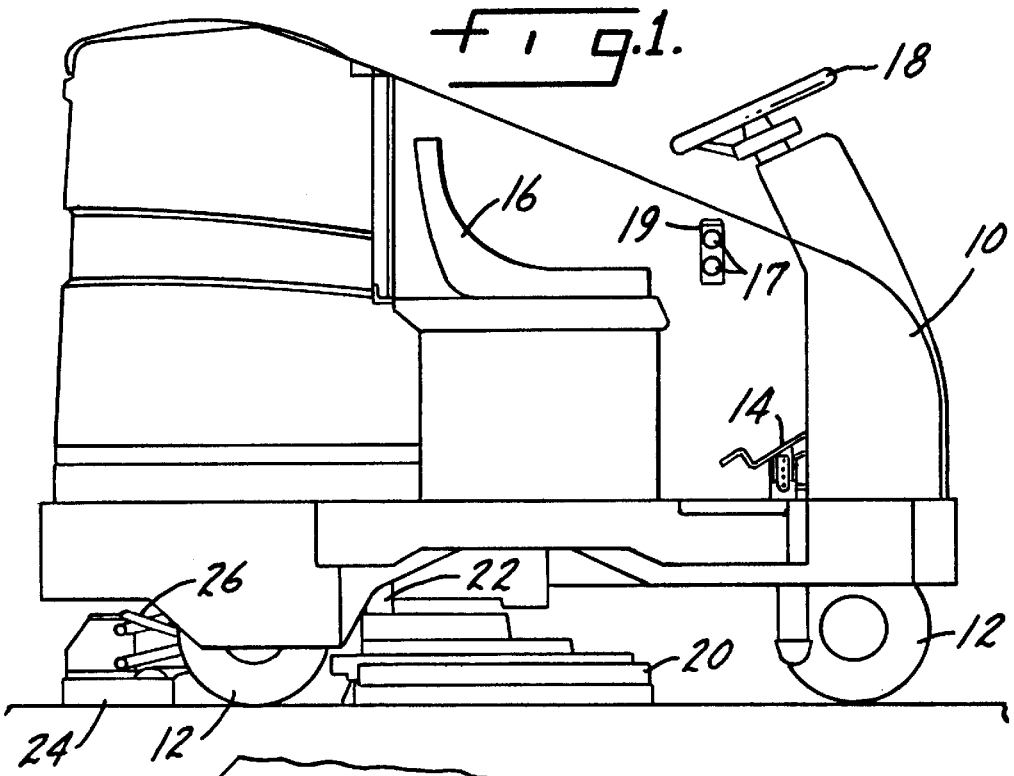
FIG. 1 is a side view of a scrubbing machine of the type disclosed herein.

In FIG. 1, the scrubbing machine is shown to include a body indicated generally at 10 which is mounted for movement on wheels 12. As is typical with scrubbing machines, there is a drive motor which in the present machine may be gasoline powered, and may include a hydrostatic propel or traction drive. As is conventional in such machines, the drive has a piston pump supplying oil to one or more hydraulic wheel motors. The pump pistons are stroked by a variable swash plate so that changing the tilt of the swash plate provides forward, neutral and reverse, and speeds from zero to maximum in either direction. The swash plate tilt is controlled by a pintle arm or lever on the side of the pump housing and that arm is connected through a push-pull cable to a heel-and-toe foot pedal controlled by the driver. The foot pedal is indicated at 14 in FIG. 1 and the described drive mechanism is well known in the art. There is a driver's seat 16 and a steering wheel 18, as is conventional in such machines. Two push buttons 17 on electronic controller 19 select either transport mode, with brushes and squeegee up, or scrub mode. A scrub brush is indicated at 20 and will be raised and lowered by a mechanism indicated generally at 22. When the machine is in scrub mode this mechanism is controlled automatically, as described hereinafter. At the rear of the machine there is a squeegee 24 which will be raised and lowered by a mechanism 26. Again, the present invention is particularly concerned with a means for automatically raising the squeegee when the machine is in scrub mode and is moved in a reverse direction.

Figure 2:
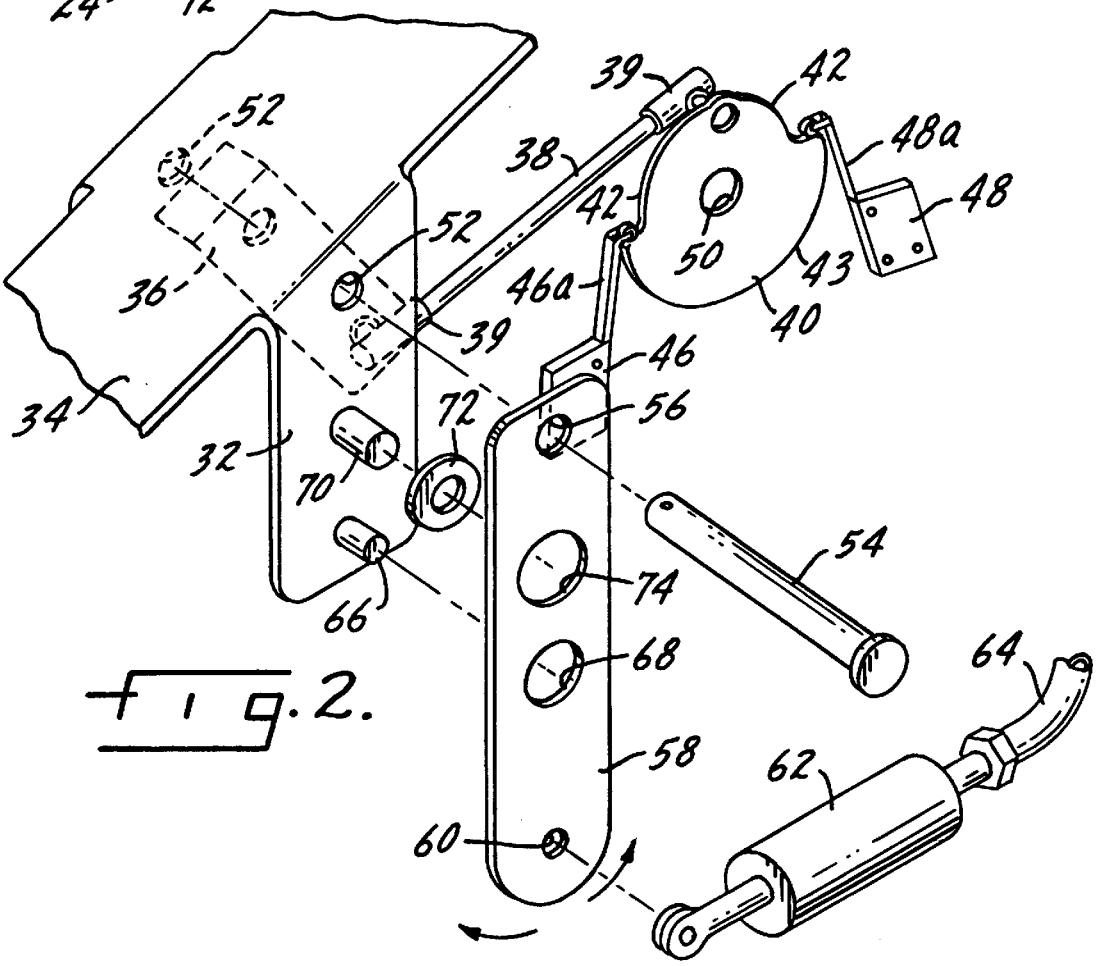
FIG. 2 is an exploded perspective of the connection between the foot pedal and the machine motor drive mechanism.
Figure 3:
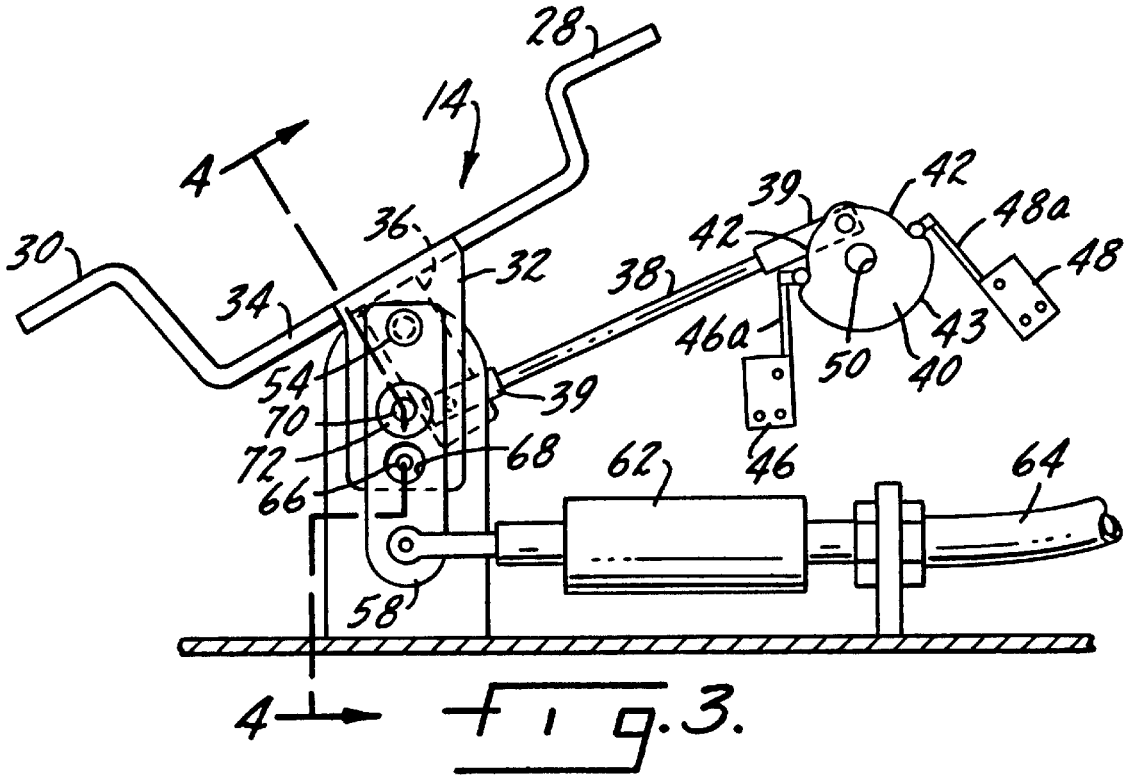
FIG. 3 is a side view of the connection between the foot pedal and the machine drive mechanism.
Figure 4:
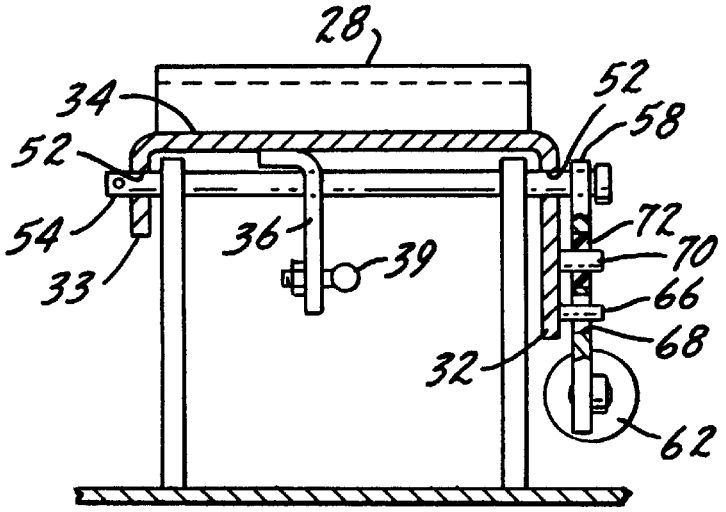
FIG. 4 is a section along plane 4—4 of FIG. 3.

FIGS. 2–4 illustrate the connection between the foot pedal and the drive mechanism that propels the machine. This connection provides for a certain degree of lost motion between actual foot pedal movement and the initiation of machine movement in either the forward or reverse directions. Such lost motion is necessary so that the scrub brush can be lowered just prior to the start of forward movement or raised just prior to change from forward motion to neutral, and the squeegee can be raised just prior to the start of movement in the reverse direction or lowered just prior to change from reverse to neutral.

The foot pedal 14 has a toe portion 28 and a heel portion 30. The foot pedal has an arm 32, shown particularly in FIG. 2, and another arm 33, which arms are integral with the center section 34 of the pedal. There is a bracket 36 depending from near the center of the section 34 of the foot pedal 14. A rod 38 is pivotally attached to the bracket 36 and to cam 40 by ball joint connectors 39, one of which may have a left-hand thread to provide convenient length adjustment of rod 38. The rod 38 will pivotally move a cam 40 having concentric circular cam tracks 42 and 43 thereon. The effective moment arm lengths of bracket 36 and cam 40 are chosen so that cam 40 will have greater angular movement than foot pedal 14. Adjacent the cam 40 are switches 46 and 48, each of which has an arm 46*a* and 48*a*. When the machine is in neutral both switch arms are on the smaller radius cam track 42 and both switches 46 and 48 are open. The scrub brushes are up and the squeegee is down. When the foot pedal is moved by the operator in either a forward or reverse direction, the cam 40 will rotate about its central pivot point 50 so that one or the other of switch arms 46*a* and 48*a* will ride up on the larger radius cam track 43, closing either one or the other of the limit switches 46 or 48, depending upon the direction of cam rotation, which in turn is dependent upon the direction of pivotal movement of the foot pedal. Switch 48 controls the mechanism that raises and lowers the scrub brush 20. Switch 46 controls the raising and lowering of the squeegee 24. The switches 46 and 48 thus function as sensors and are operable upon forward or reverse movement of the foot pedal, with the neutral position of the foot pedal shown in FIGS. 2 and 3 being one in which neither switch is closed and the machine has neither forward nor reverse movement.

The arms 32 and 33 of the foot pedal 14 have a pair of spaced holes 52 which receive a pivot pin 54, with the pin extending through an aligned opening 56 in a lever 58. Thus, the lever 58 is attached to the foot pedal and, as described hereinafter, will move with the foot pedal through the lost motion connection shown in FIGS. 2, 3 and 4. The lower end of lever 58 has a hole 60 by which the lever is pivotally attached to a well-known centering spring device 62, the opposite end of which is connected to a cable 64 which in turn will be connected to the pump pintle arm described above as being the means for changing speed and direction of the drive motor for the machine.

Arm 32 of foot pedal 14 includes a first pin 66 which may be welded to the arm and extends through an aligned opening 68 in the lever 58. The opening 68 is larger than the pin 66, with the clearance between these elements, approximately .2", diameter to diameter, providing for lost motion between foot pedal movement and actuation of cable 64. There is a second pin 70 which is also welded to the arm 32 intermediate the pin 66 and the pivot opening 52. An elastomeric washer 72 fits over pin 70 and the elastomeric washer 72 is sized to fit snugly within an opening 74 in the lever 58.

When the foot pedal is moved in a forward direction, by downward pressure on the toe portion 28, the resilient centering washer 72 will yield, and there will be no movement of the lever 58 until the pin 66 contacts the edge of opening 68. The centering washer 72 will thus permit several degrees of rotation of the pedal before overcoming the detented centering force of the spring device 62. However, before rotation of the foot pedal will actually cause movement of the lever 58, cam 40 will have rotated counterclockwise and the arm 48*a* of switch 48 will have closed the switch, causing the scrub brush to be lowered. Thus, just prior to forward movement of the machine, the scrub brush will be lowered.

When machine movement is in the reverse direction, the operator will press downward with his heel on heel portion 30 and the foot pedal will pivot in a counterclockwise direction which will cause cam 40 to rotate in a clockwise direction, causing switch arm 46*a* to move, closing switch 46. The closure of this switch causes the squeegees to be raised through the above-described squeegee mechanism 24. Again, the motion of the foot pedal will cause movement of the cam 40 prior to the time that foot pedal movement will cause movement of lever 58. This lost motion permits the closure of the switches prior to the time that foot pedal movement is translated into movement of the scrubbing machine.

There is a further advantage of the above-described lost motion connection in that the contacts of the switches which will cause squeegee and brush movement will be opened prior to the time that the foot pedal reaches a neutral position. Thus, from forward travel the scrub brush will be raised just prior to the foot pedal reaching a neutral position and the squeegees will similarly be lowered just prior to the time that a neutral position has been reached. In addition, the centering washer will center the foot pedal when the driver relaxes or lifts his foot. And when the driver's foot is off the pedal the washer will also keep the pedal from bouncing and causing the switches to chatter.

The centering force provided by the washer 72 can be changed, depending upon the durometer of the elastomer that is used in the washer. Similarly, the amount of pedal rotation which is permitted before the machine is actually moved in a forward or reverse direction can be fine tuned by adjusting the relative sizes of pin 66 and opening 68.

Also, the length of rod 38 can be adjusted by screwing it in or out of connectors 39 in turnbuckle fashion. This is to set the neutral position of cam 40 to match the neutral position of foot pedal 14, given to it by the neutral detent in centering spring device 62 acting through lever 58 and elastomeric washer 72.

Whereas the preferred form of the invention has been shown and described herein, it should be realized that there may be many modifications, substitutions and alterations thereto.

The embodiments of the invention in which an exclusive property or privilege is claimed are defined as follows:

1. An operator controlled scrubbing machine including a body, wheels for supporting said body, a scrub brush on said body and means for raising and lowering said scrub brush, a squeegee on said body and means for raising and lowering said squeegee, drive means on said machine for moving said machine in forward and reverse directions, and an operator controlled foot pedal for controlling said drive means, a connection between said foot pedal and said drive means providing for limited foot pedal movement prior to translating foot pedal movement to machine forward and reverse movement, a first sensor to sense machine forward movement of said foot pedal, said sensor being connected to the means for raising and lowering said scrub brush, a second sensor to sense machine reverse movement of said foot pedal, said second sensor being connected to the means for raising and lowering said squeegee, said first and second sensors being positioned to sense foot pedal machine forward and machine reverse movements prior to such movements being translated into machine forward and reverse movements so that said scrub brush will be lowered prior to machine forward movement, and said squeegee will be raised prior to machine reverse movement.

2. The scrubbing machine of claim 1 wherein said connection between said foot pedal and said drive means includes a lever pivotally connected to said drive means and pivotally connected to said foot pedal, one of said connections being a lost motion connection.

3. The scrubbing machine of claim 2 wherein the connection between said foot pedal and said lever is a lost motion connection.

4. The scrubbing machine of claim 3 wherein said lost motion connection includes a first pin extending from said foot pedal and a first opening in said lever aligned with said pin and having a diameter greater than the outer diameter of said pin.

5. The scrubbing machine of claim 4 wherein said lost motion connection includes a second pin attached to said foot pedal, an elastomeric washer positioned about said second pin, a second opening in said lever aligned with said second pin and elastomeric washer, there being a close fit between said second opening and said elastomeric washer.

6. The scrubbing machine of claim 5 wherein said lost motion connection includes aligned openings in said lever and foot pedal, a pivot pin extending through said aligned openings, said second pin and elastomeric washer being positioned intermediate said pivot pin and the first pin and its lever opening, whereby pivotal movement of said foot pedal will cause said lever to turn, without activating said drive means, through a distance equal to the diametral clearance between said first pin and said first lever opening.

7. The scrubbing machine of claim 1 wherein said sensors include switches having cam arms thereon.

8. The scrubbing machine of claim 7 including a cam member positioned adjacent said switch arms and connected to rotate upon pivotal movement of said foot pedal whereby rotation of said cam member will contact said arms to open and close said switches.

* * * * *